US006129063A

United States Patent [19]

Niethammer et al.

[11] Patent Number: 6,129,063

[45] Date of Patent: Oct. 10, 2000

[54] DEVICE FOR CHANGING THE ROTATIONAL POSITION OF A SHAFT RELATIVE TO A DRIVE WHEEL AND METHOD OF MAKING SAME

[75] Inventors: Bernd Niethammer, Nuertingen; Andreas Knecht, Ammerbuch, both of Germany

[73] Assignee: Dr. Ing. h.c.F. Porsche AG, Weissach, Germany

[21] Appl. No.: 09/359,433

[22] Filed: Jul. 22, 1999

[30] Foreign Application Priority Data

Aug. 1, 1998 [DE] Germany ..... 198 34 843

[51] Int. Cl.[7] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS 5,836,276 11/1998 Iwasaki et al. ..... 123/90.17

5,937,810 8/1999 Sato et al. ..... 123/90.17

FOREIGN PATENT DOCUMENTS

0781899A1 7/1997 European Pat. Off. .

197 45 908 4/1999 Germany .

*Primary Examiner*—Weilun Lo

*Attorney, Agent, or Firm*—Evenson, McKeown, Edwards & Lenahan, P.L.L.C.

[57] ABSTRACT

A device for changing the rotational position of a shaft relative to a drive wheel has an adjusting device with two pressure chambers that act against one another. The chambers are pressurized by a pressure medium pump. The adjusting device includes an inner part with ribs that divides the chambers formed by the ribs of a compartmented wheel into corresponding pressure chambers. A plurality of depressions extending axially are machined into the circumferential surfaces of the compartmented wheel that faces the ribs of the inner part, which depressions serve to collect dirt particles carried by the pressure medium into the pressure chambers.

22 Claims, 3 Drawing Sheets

DEVICE FOR CHANGING THE ROTATIONAL POSITION OF A SHAFT RELATIVE TO A DRIVE WHEEL AND METHOD OF MAKING SAME

BACKGROUND AND SUMMARY OF THE INVENTION

This application claims the priority of German application 198 34 832.6, filed in Germany on Aug. 1, 1998, the disclosure of which is expressly incorporated by reference herein.

The invention relates to a device for changing the At rotational position of a shaft relative to a drive wheel, especially of a camshaft of an internal combustion engine with an adjusting device that can be pressurized hydraulically and which includes two pressure chambers that act against one another, said chambers being formed by an inner part connected with the shaft and a compartmented wheel of the adjusting device that is connected with the drive wheel, with at least one depression in the wall area of each of the pressure chambers.

A device of this kind is known for example from European Patent Document EP 0 781 899 A1. This document describes a device for changing the rotational position of the camshaft of an engine, with the camshaft being connected nonrotatably with an inner wheel, said wheel having vanes arranged radially and dividing the associated compartments of a compartmented wheel into two pressure chambers each that act against one another. These pressure chambers are pressurized hydraulically by a control valve. Depending upon the pressurization, the inner wheel is rotated relative to the compartmented wheel. The walls of the compartmented wheel that extend radially are provided in the vicinity of their radial outer sides with depressions provided to receive dirt particles that are introduced by the pressure medium into the pressure chambers. The dirt particles contained in the pressure medium, depending on the rotational direction of the camshaft, as a result of the accelerations acting on them and of their inertia, accumulate primarily in one of the two depressions. This depression is the one located to the rear relative to the rotational direction. The dirt particles located on the front side of each vane or rib of the inner part can be pressed by their relative movement into the front depression of the compartmented wheel, but because of their inertia they do not remain there. Therefore, with such an adjusting device, there is the danger that smaller dirt particles in particular in the sealing gap between the vane and the rib, will penetrate the compartmented wheel and result in considerable wear and a sealing effect that decreases over time. In addition, the penetration of dirt particles into this sealing area can lead to a sharp increase in friction. This would result in a much higher pressure requirement to achieve a sufficiently rapid adjustment. Moreover, such depressions in the walls between the adjoining compartments require relatively thick walls and are located in an area that is unfavorable from the standpoint of stress. The considerable wall thickness required by the depressions consequently reduces the width of the adjoining compartments in the circumferential direction of the adjoining compartments, so that the adjustment angle is reduced overall.

On the other hand, a goal of the invention is to improve the adjusting device of the type generally described above in such fashion that dirt particles can settle out of the pressure medium in non-critical areas of the pressure chambers without the danger of increased friction and/or increased wear in the area of the sealing surface.

This goal is achieved according to preferred embodiments of the invention by providing a device of the above described type wherein the depressions are formed in a radially external circumferential surface of the compartmented wheel. By locating the depressions in the radially external circumferential surface, the dirt particles that collect in the depressions under the influence of acceleration, due to their inertia, are prevented from again penetrating the sealing surface between the vane or rib and the circumferential surface of the compartmented wheel. By locating the depressions in the circumferential surface, moreover, the thickness of the radial compartment walls is not reduced so that the maximum possible adjustment angle is retained.

If a plurality of depressions are machined into the circumferential surface in each pressure chamber around the circumference, in an especially advantageous manner the distance can be reduced that dirt particles must travel along the circumferential surface until they can settle in a depression.

Especially simple machining of the compartmented wheel and a relatively large volume to receive the dirt particles are obtained when the depressions extend in the axial direction over the entire length of the pressure chamber.

Despite the location of the depressions in the circumferential area and consequently in the vicinity of the sealing surface with the adjoining rib of the inner part, a good seal can be ensured if the width of the depressions, viewed in the circumferential direction, is chosen so that in each case at least two depressions are sealed by the adjoining end of a rib. The part of the circumferential surface located between the depressions therefore has a sufficient sealing length for the operation of the adjusting device.

An especially good sealing effect at the circumferential surface is achieved if the width of the depressions and/or of the spaces between the depressions is less than 20 percent of the width of the adjoining rib.

An even further improved sealing effect is achieved when the width and/or the distance between the depressions is less than 10 percent of the width of the adjoining rib.

A good and rapid collection of dirt particles with a simultaneous high sealing effect is achieved when the width of the depressions is approximately 0.5 to 1 mm. The depth of the depressions in the radial direction is preferably in the range between 0.2 and 0.5 mm. The depressions can then have a square cross section for example. A design that is especially favorable from the manufacturing standpoint is obtained when the depressions have an approximately semicircular cross section with a slightly conical opening area to the inner chamber.

A compartmented wheel with depressions on its circumferential surface can be manufactured in an especially advantageous and economical fashion as a sintered part. The depressions to receive the dirt particles can then be formed by the sintering process itself. The machining of the circumferential surface following the sintering process is then possible without additional effort or additional cost, as in the case of parts without depressions.

Other objects, advantages and novel features of the present invention will become apparent from the following detailed description of the invention when considered in conjunction with the accompanying drawings.

DETAILED DESCRIPTION OF THE DRAWINGS

Figure 1:
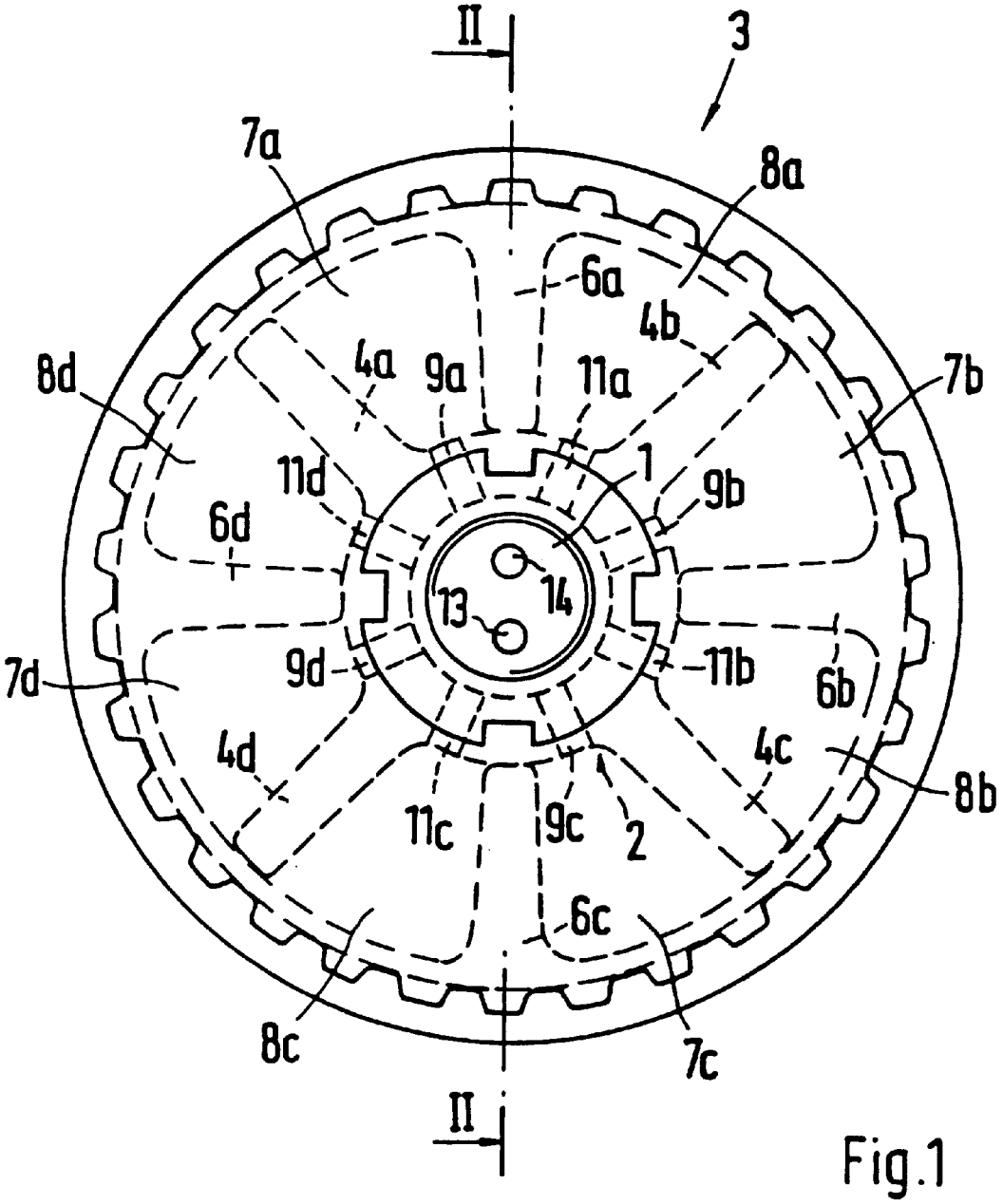
FIG. 1 is a schematic end view of the adjusting device as seen from the side facing away from the camshaft.

In the drawings, 1 represents the camshaft of an internal combustion engine, at whose free end the inner part 2 of an adjusting device 3 is mounted nonrotatably. This inner part 2 in this embodiment is provided with four radial ribs 4*a* to 4*d*. The inner part is surrounded by a compartmented wheel 5 connected in a manner not shown in greater detail with the crankshaft of the engine, and consequently acts as a drive wheel. Compartmented wheel 5 is provided with four inwardly projecting radial ribs 6*a* to 6*d*, between which four compartments are formed that are divided by the ribs of the inner part into two pressure chambers 7*a* to 7*d* or 8*a* to 8*d* each. These pressure chambers are designed so that the total of the hydraulically effective surfaces is the same in both adjustment directions. Pressure chambers 7*a* to 7*d* are each connected by a radial bore 9*a* to 9*d* in the inner part with an annular groove 10 on camshaft 1. Pressure chambers 8*a* to 8*d* are connected in similar fashion by radial bores 11*a* to 11*d* in the inner part with a second annular groove 12 in the camshaft. The annular groove 10 is connected with pressure channel 14 and annular groove 12 is connected with pressure channel 13. These pressure channels 13 and 14 are connected in a manner known of itself by a camshaft bearing 15 with one control line 16 or 17 each. The two control lines 16 and 17 are connected to a control valve 18, designed for example as a 4/3-wave valve. This control valve 18 is connected firstly with a pressure medium pump 19 and secondly with an oil tank 20.

Figure 2:
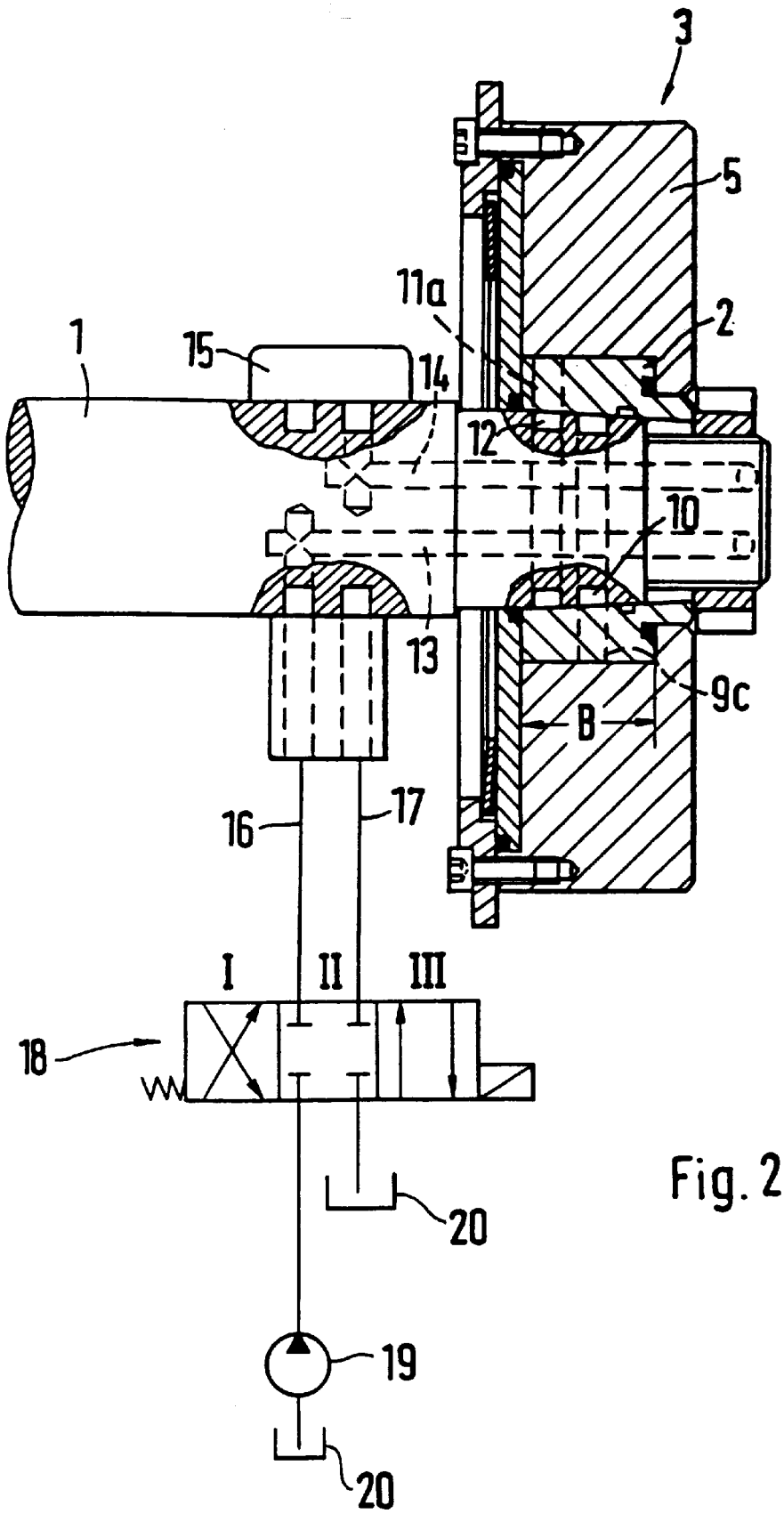
FIG. 2 is a sectional view along line II—II in FIG. 1.

In the switch position II shown in FIG. 2 (neutral position) all four connections to the control valve 18 are closed at one end. Adjusting device 3 is thus hydraulically locked or clamped and retains its assumed position of the inner part and compartmented wheel. In switch position I of control valve 18, pressure chambers 7*a* to 7*d* are connected by bores 9*a* to 9*d*, annular groove 10, pressure channel 14, and line 17 with pressure from pressure medium pump 19. At the same time, pressure chambers 8*a* to 8*d* are relieved of pressure through bores 11*a* to 11*d*, annular groove 12, pressure channel 13, and control line 16 to oil tank 20. As a result of this pressure increase in pressure chambers 7*a* to 7*d* and the simultaneous pressure relief in pressure chambers 8*a* to 8*d*, the inner wheel in the view selected in FIG. 1 is rotated counterclockwise relative to the compartmented wheel. In switch position III of control valve 18, the control line 16 is connected with pressure medium pump 19 and control line 17 is connected with oil tank 20. Thus, pressure chambers 8*a* to 8*d* are pressurized through the oil guide channels described above and pressure chambers 7*a* to 7*d* are relieved of pressure. Inner part 2 is thus rotated clockwise relative to compartmented wheel 5.

Figure 3:
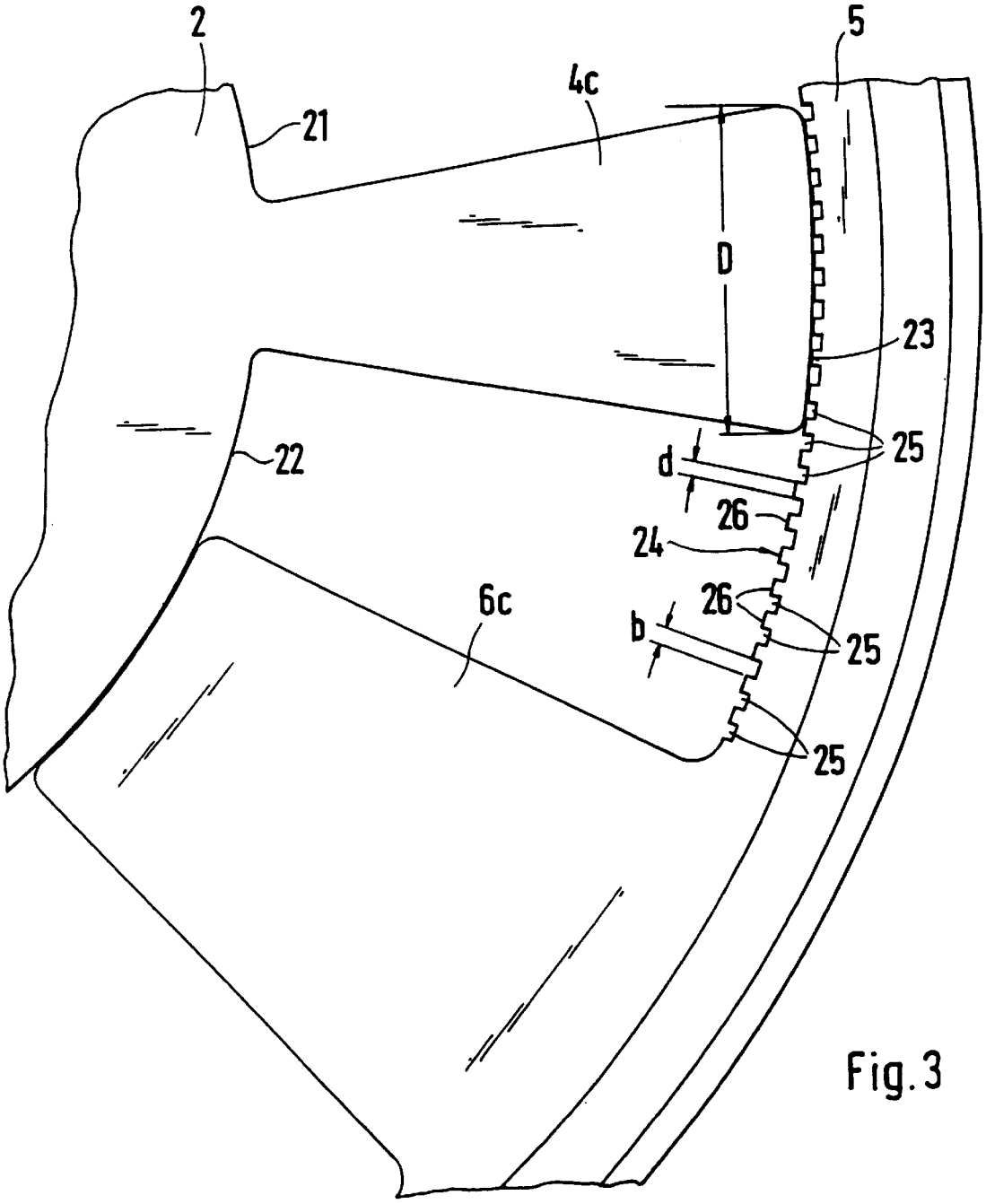
FIG. 3 is an enlarged portion of FIG. 1.

As shown in FIG. 1 and in the enlarged portion in FIG. 3, the ribs 6*a* to 6*d* of compartmented wheel 5 each abut the inner circumferential surface 21 of inner part 2 with their ends in a sealing fashion. The ribs 4*a* to 4*d* on the inner part abut the inner circumferential surface 24 of compartmented wheel 5 by their ends 23 which are convex in the circumferential direction, in a sealing fashion. A plurality of depressions 25 extending axially are machined into this inner circumferential surface 24. These depressions in this embodiment are in the form of lengthwise grooves with a rectangular cross section. Other cross-sectional shapes, such as trapezoidal cross sections, triangular cross sections, or rounded cross sections are also possible. Depressions 25 extend in the axial direction over the entire width of the pressure chambers 7*a* to 7*d* and 8*a* to 8*d* of the width B of the ribs 4*a* to 4*d*, 6*a* to 6*d*. These depressions are distributed at regular intervals around the circumference. In this embodiment, the width b and the distance d are chosen so that approximately 30 depressions are provided in each pressure chamber. Distance d is thus defined as the distance between two adjacent lateral surfaces of the adjoining depressions. This distance corresponds to the width of the remaining rib 26 on the circumferential surface which abuts end 23 of the rib in a sealing fashion. The width D or the arc length of end 23 and the width b as well as the distances d of the depressions are adjusted to one another in this embodiment so that in each case approximately 10 depressions 25 are covered by end 23.

The width b of the depressions in the embodiment shown here is approximately 0.75 mm. However, it is readily possible to vary the width b of the depressions between approximately 0.5 mm and 1 mm. The depth (in the radial direction of depressions 25) in the embodiment shown here is approximately 0.35 mm. However, it is also readily possible to vary the depth in the range between approximately 0.2 mm and 0.5 mm. The depressions 25 in the embodiment shown here have an approximately rectangular cross section. However, it is also readily possible to design these depressions with an approximately semicircular cross section with a slightly conical opening area to the inner chamber.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for changing the rotational position of a camshaft relative to a drive wheel, in an internal combustion engine, with an adjusting device that can be pressurized hydraulically and which includes two pressure chambers that act against one another, said chambers being formed by an inner part connected with the shaft and a compartmented wheel of the adjusting device that is connected with the drive wheel, with at least one depression in a wall area of each of the pressure chambers, wherein the depressions are formed in a radially outermost circumferential surface of the compartmented wheel.

2. Device for changing the rotational position of a shaft relative to a drive wheel according to claim 1, wherein a plurality of said depressions is machined into the circumferential surface and distributed over the circumference of each pressure chamber.

3. Device for changing the rotational position of a shaft relative to a drive wheel according to claim 1, wherein the depressions are machined at regular intervals into the circumferential surface.

4. Device for changing the rotational position of a shaft relative to a drive wheel according to claim 2, wherein the depressions are machined at regular intervals into the circumferential surface.

5. Device for changing the rotational position of a shaft relative to a drive wheel according to claim 3, wherein the depressions extend in the axial direction over the entire width of the pressure chambers.

6. Device for changing the rotational position of a shaft relative to a drive wheel according to claim 4, wherein the depressions extend in the axial direction over the entire width of the pressure chambers.

7. Device for changing the rotational position of a shaft relative to a drive wheel according to claim 1, wherein the depressions are in the form of grooves that extend axially.

8. Device for changing the rotational position of a shaft relative to a drive wheel according to claim 4, wherein the depressions are in the form of grooves that extend axially.

9. Device for changing the rotational position of a shaft relative to a drive wheel according to claim 1, wherein the width and the distances d between the depressions are chosen so that in each case at least two depressions are covered by the adjoining ends of a rib of the inner part.

10. Device for changing the rotational position of a shaft relative to a drive wheel according to claim 4, wherein the width and the distances d between the depressions are chosen so that in each case at least two depressions are covered by the adjoining ends of a rib of the inner part.

11. Device for changing the rotational position of a shaft relative to a drive wheel according to claim 1, wherein the width of the depressions in the circumferential direction is less than ⅕ of the width of the adjoining rib of the inner part.

12. Device for changing the rotational position of a shaft relative to a drive wheel according to claim 4, wherein the width of the depressions in the circumferential direction is less than ⅕ of the width of the adjoining rib of the inner part.

13. Device for changing the rotational position of a shaft relative to a drive wheel according to claim 1, wherein the circumferential spacing of the depressions is less than ⅕ of the circumferential width of the adjoining rib of the inner part.

14. Device for changing the rotational position of a shaft relative to a drive wheel according to claim 4, wherein the ircumferential spacing of the depressions is less than ⅕ of he circumferential width of the adjoining rib of the inner part.

15. Device for changing the rotational position of the shaft relative to a drive wheel according to claim 1, wherein the width of the depressions, in the circumferential direction, is less than 1/10 of the width of the adjoining rib of the compartmented wheel.

16. Device for changing the rotational position of a shaft relative to a drive wheel according to claim 1, wherein the distance between the depressions is less than 1/10 of the width of the adjoining rib of the inner part.

17. Device for changing the rotational position of a shaft relative to a drive wheel according to claim 1, wherein the compartmented wheel is designed as a sintered part, and the depressions are formed during the sintering process.

18. Device for changing the rotational position of a shaft relative to a drive wheel according to claim 1, wherein the width of the depressions is less than or equal to 1 mm.

19. Device for changing the rotational position of a shaft relative to a drive wheel according to claim 1, wherein the width of the depressions is equal to or greater than 0.5 mm.

20. Device for changing the rotational position of a shaft relative to a drive wheel according to claim 1, wherein the depth of the depressions is less than or equal to 0.5 mm.

21. Device for changing the rotational position of a shaft relative to a drive wheel according to claim 1, wherein the depth of the depressions is greater than or equal to 0.2 mm.

22. A method of making a device for changing the rotational position of a camshaft relative to a drive wheel, in an internal combustion engine, with an adjusting device that can be pressurized hydraulically and which includes two pressure chambers that act against one another, said chambers being formed by an inner part connected with the shaft and a compartmented wheel of the adjusting device that is connected with the drive wheel, with at least one depression in a wall area of each of the pressure chambers, wherein the depressions are formed in a radially outermost circumferential surface of the compartmented wheel, said method comprising forming the compartmented wheel by sintering with said depressions formed during the sintering process.

* * * * *